United States Patent [19]

Chen

[11] Patent Number: 4,636,189

[45] Date of Patent: Jan. 13, 1987

[54] MACHINE FOR PLACING A PLASTIC BAG AUTOMATICALLY INTO A LARGER FEEDSTUFF BAG

[76] Inventor: Yaw H. Chen, 3-3, Ta Chyan, Pu Yuan Tsuen, Yeong Kang Shiang, Tainan Hsien, Taiwan

[21] Appl. No.: 813,133

[22] Filed: Dec. 24, 1985

Related U.S. Application Data

[63] Continuation-in-part of Ser. No. 548,121, Nov. 2, 1983, abandoned.

[51] Int. Cl.[4] ..... B31B 39/04; B31B 39/80

[52] U.S. Cl. ..... 493/217; 493/256; 493/316; 493/922; 53/175

[58] Field of Search ..... 493/217, 256, 922, 967, 493/316; 53/175

[56] References Cited

U.S. PATENT DOCUMENTS

| | | | |
|---|---|---|---|
| 1,834,189 | 12/1931 | Thiem | 493/256 |
| 4,015,515 | 4/1977 | Johnson | 493/217 |
| 4,200,481 | 4/1980 | Faller | 156/382 |

*Primary Examiner*—Francis S. Husar
*Assistant Examiner*—William E. Terrell
*Attorney, Agent, or Firm*—Browdy and Neimark

[57] ABSTRACT

An automatic machine for placing a plastic bag into a larger feedstuff bag. The plastic bag and feedstuff bag to open by the action of two vacuum holders connected to the upper and lower vacuum tanks. A push rod is then introduced, via the opening of the plastic bag to push the plastic bag into the feedstuff bag.

2 Claims, 25 Drawing Figures

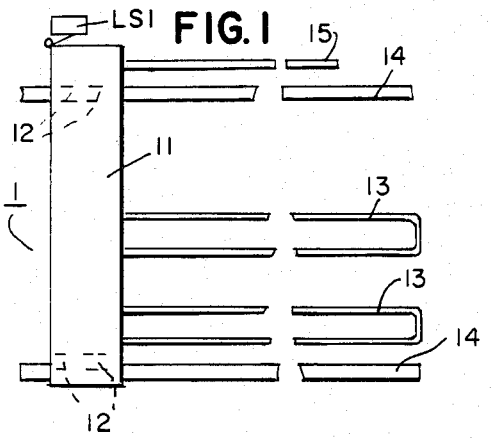
FIG. 1
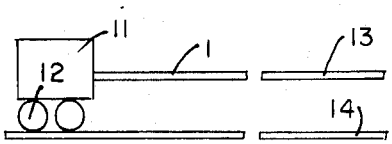
FIG. 2
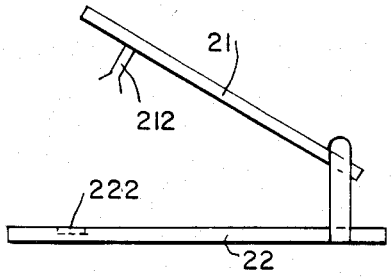
FIG. 4
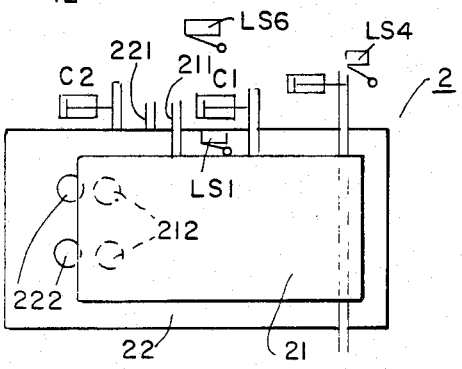
FIG. 3
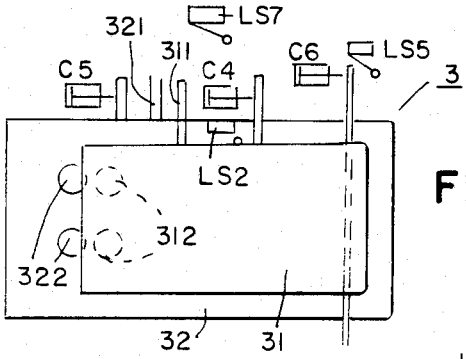
FIG. 5
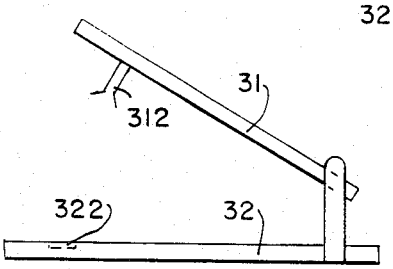
FIG. 6
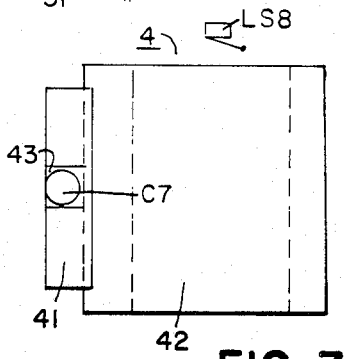
FIG. 7
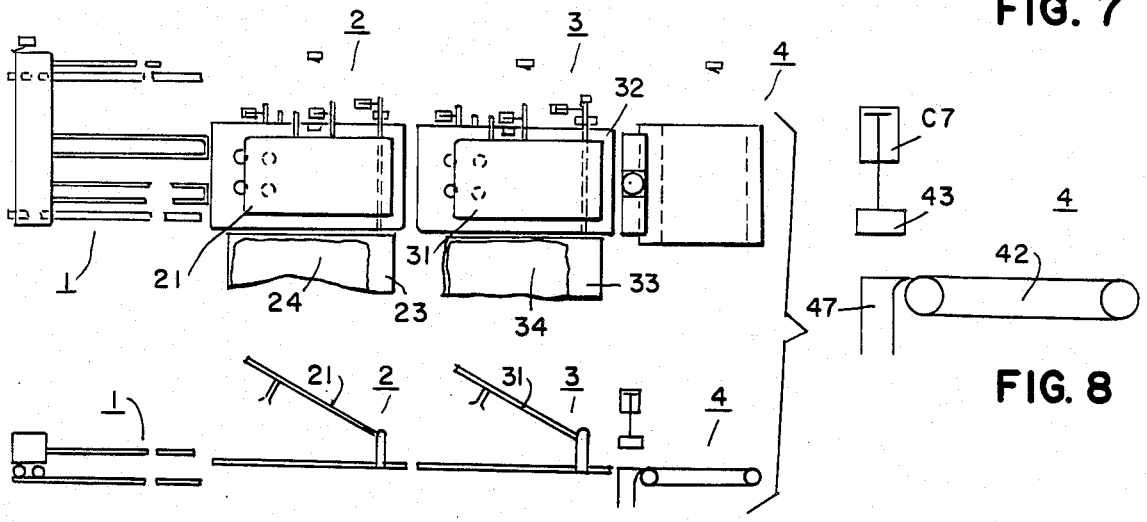
FIG. 8
FIG. 9

FIG. 3a
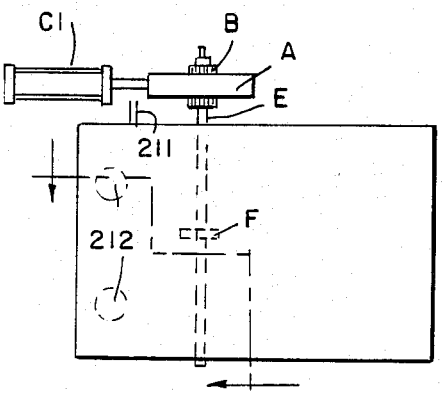
FIG. 3b
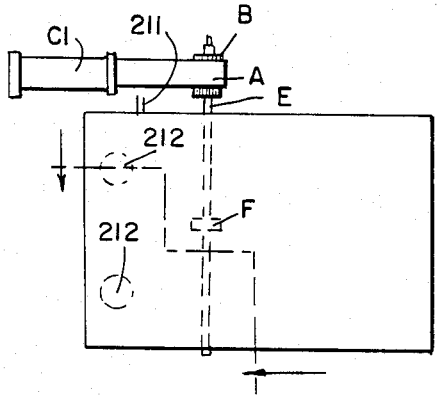
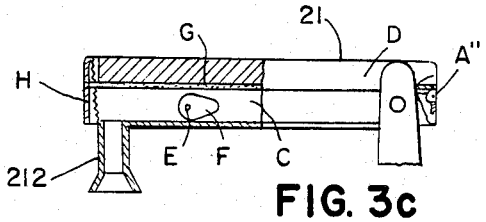
FIG. 3c
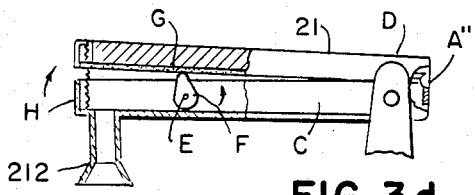
FIG. 3d
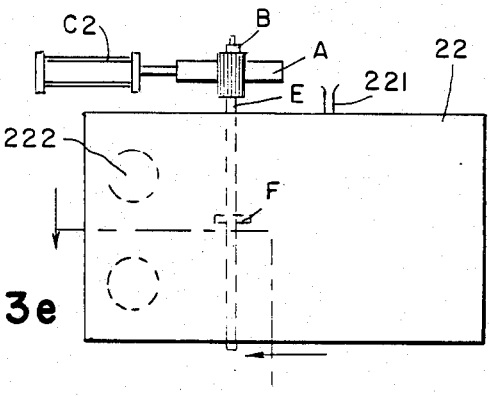
FIG. 3e
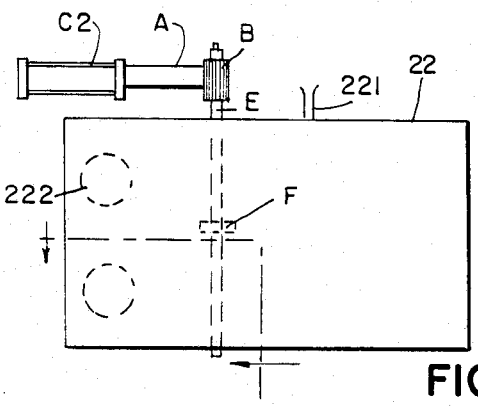
FIG. 3f
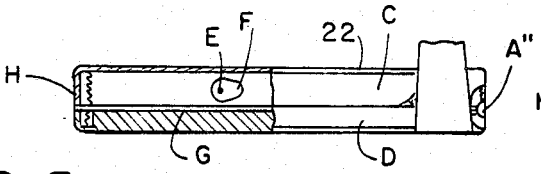
FIG. 3g
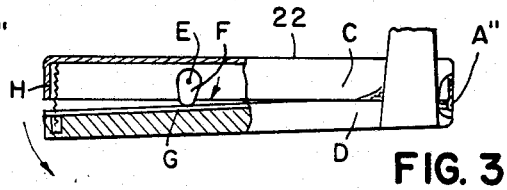
FIG. 3h
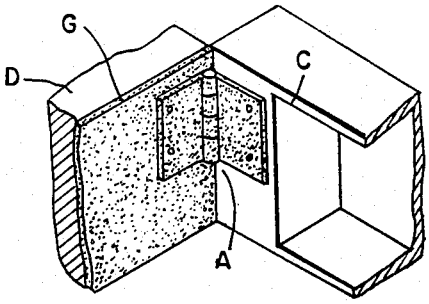
FIG. 3i
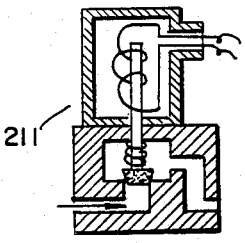
FIG. 3j
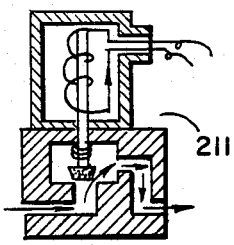
FIG. 3k

MACHINE FOR PLACING A PLASTIC BAG AUTOMATICALLY INTO A LARGER FEEDSTUFF BAG

CROSS-REFERENCE TO RELATED APPLICATIONS

This application is a continuation-in-part of Ser. No. 548,121, filed Nov. 2, 1983, now abandoned.

SUMMARY OF THE INVENTION

The present invention provides for an automatic machine for placing a plastic bag into a larger feedstuff bag. It is common knowledge that a plastic bag must be placed into a feedstuff bag in cases where the latter is meant to hold powdered or particled articles because, as a rule, most feedstuff bags are made from the interwoven warp yarn and weft yarns, which inevitably have innumerable fine holes. The use of a plastic lining bag prevents leakage of the powdered feedstuff contained within and also reinforces the feedstuff bag.

Two methods are known to date for putting a plastic bag into a main feedstuff bag. One method employs an automatic machine to put the plastic bag directly into a feedstuff bag that is in the weaving process, then seals the terminal edges, which are then slit to form for finished twin bags. This method is satisfactory, but the production cost of such an automatic machine runs as high as ten million dollars, which is exorbitantly expensive, and for that reason few plants can afford to buy such a machine. In another method, one separately prepares the feedstuff bag and the plastic bag meant to put therein. The latter is then placed into the former by manual labor. This method is inefficient and labor intensive.

The primary object of the present invention is to provide a machine for putting a lining plastic bag automatically into a main feedstuff bag at a moderate production cost.

To illustrate the present invention purposes, a preferred embodiment is set forth by reference to the accompanying drawings, in which the components include an activation means 1, a stock piler 2 for the plastic bags, a stock piler 3 for the feedstuff bags, and a product station 4.

DESCRIPTION OF THE DRAWING

FIG. 1 is a top view of the activation means according to a preferred embodiment of the present invention;

FIG. 2 is a front view of the activation means according to a preferred embodiment of the present invention;

FIG. 3 is a top view of the stock piling device of the plastic bag according to a preferred embodiment of the present invention;

FIG. 3*a* is a top view of the closed upper tank.

FIG. 3*b* is a top view of the open upper tank.

FIG. 3*c* is a cross-sectional view of the closed upper tank.

FIG. 3*d* is a cross-sectional view of the open upper tank.

FIG. 3*e* is a top view of the closed lower tank.

FIG. 3*f* is a top view of the open lower tank.

FIG. 3*g* is a partial cross-sectional view of the closed lower tank.

FIG. 3*h* is a partial cross-sectional view of the open lower tank.

FIG. 3*i* is a view of a hinge used to connect the parts "C" and "D" of the tank.

FIG. 3*j* and 3*k* are drawings showing the open and closed state of a vacuum valve, in this case valve 211, but it is also representative of valves 221, 311 and 321; FIG. 3*j* shows a valve in a closed state when the circuit is not on; FIG. 3*k* shows a valve in an open state when the circuit is on.

FIG. 4 is a front view of the stock piling mechanism for the plastic bag according to a preferred embodiment of the present invention;

FIG. 5 is a top perspective of the stock piling section for the feedstuff bag according to a preferred embodiment of the present invention;

FIG. 6 is a front view of the stock piling section for the feedstuff bag according to a preferred embodiment of the present invention;

FIG. 7 is a top perspective of the product according to a preferred embodiment of the present invention.

FIG. 8 is a front view of the product collection station according to a preferred embodiment of the present invention;

FIG. 9 is a layout perspective of a preferred embodiment according to the present invention in a stationary condition, including both a top view and a front view thereof;

DETAILED DESCRIPTION

Figure 10:
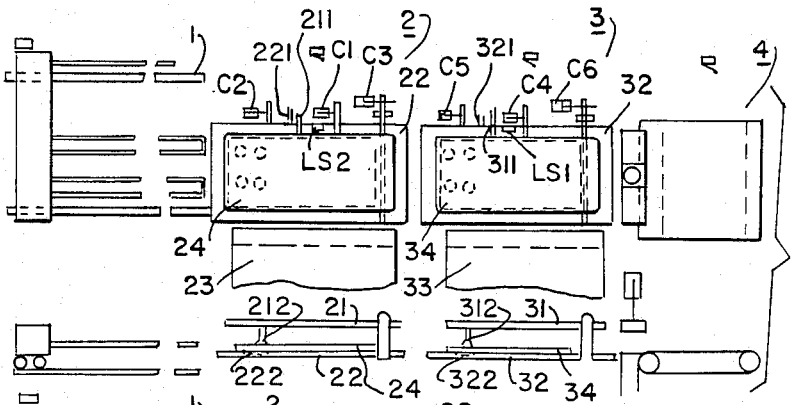
FIG. 10 is a perspective of the operation procedure of a preferred embodiment according to the present invention, including both a top view and a front view thereof.

Referring first to FIGS. 1 and 2, it is seen that the activation means 1 includes transmission shaft box 11, push wheel 12, two push rods 13, a rail 14 and an abutment bar 15, characterized in that transmission shaft box 11 can progress forward under the influence of a motorized transmission, and that push wheel 12 is provided underneath transmission shaft box 11 so as to come into abutment against rail 14, abutment bar 15 being of suitable length; and also in that an abutment switch LS1, otherwise called a limit switch is provided on one side of transmission shaft box 11.

Referring now to FIG. 3*a* and FIG. 4, there is shown upper vacuum tank 21 and lower vacuum tank 22, provided for the stock piler 2. Upper vacuum tank 21 is provided with a vacuum line (not shown) which has a vacuum valve and is connected to a vacuum pump (not shown); a number of suction holders 212; and a vacuum rupture system. Lower vacuum tank 21 opens upwardly, as shown in FIG. 3*d*. Also the lower vacuum tank 22 is provided with a vacuum line (not shown) which has a vacuum valve 221 and is connected to the vacuum pump (not shown): a number of suction holders 222; and a vacuum rupture system. The opening orifice of the lower vacuum tank opens downwardly, as shown in FIG. 3*h*. Upper vacuum tank 21 can be opened or closed under the control of cylinder C1 as provided on one side thereof, whereas the lower vacuum tank 22 can be opened or closed in the same manner by the control of another cylinder C2. The opening and closing of the tanks is accomplished as illustrated in FIGS. 3*a*–3*i*.

Referring to these figures, cylinder C1 (C2) is connected to rack gear A. Rack gear A engages gear B. Vacuum tank 21 (22) has a fixed hollow body C and a hinged door D connected to hollow body C by hinge A. Gear B rests on one side of the hollow body C and is fitted about a rod E which perforates both side walls of hollow body C and extends therethrough. A cam F is fixed about the center of rod E, within hollow body C. A packing G is provided between hollow body G and hinged door D. The packing may be provided on the entire bottom surface or edges of door D or on the top surfaces of the side walls of hollow body C. This packing prevents leakage of air and consequent loss of vacuum when door D abuts hollow body C.

A spring H is fixed to and extends from the bottom surface of hollow body C, to the bottom surface of door D, to which the spring is also attached. If packing G is present over the entire bottom surface of door D, rather than the top surface of the side walls of hollow body C, the spring H extends through a bore in this packing. Spring H constantly exerts a compressive force, thereby biasing door D in a closed position relative to hollow body C or just the edges of door D. When cam F is in the position shown in FIGS. 3*c* and 3*g*, this biasing force keeps door D closed.

While the tanks are closed, packing G prevents the leakage of air from the vacuum tanks 21, 22, 31, 32. The constantly operating pump (not shown) withdraws air from the tanks 21, 22, 31, 32 through open vacuum valves 211, 221, 311 and 321 (see FIG. 3*j*) (the opening and closing of these valves is further discussed below), thereby creating a vacuum. Thus, suction holders 222, 212, 312 and 322 become operative.

As the piston within cylinder C1 (C2) moves forwards, rack gear A, attached to the piston, also moves forward at the same time. This forward movement rotates gear B counterclockwise. The counterclockwise rotation of gear B in turn rotates core E. As a result, cam F rotates into the position shown in FIGS. 3*d* and 3*h*, thereby forcing door D open against the biasing force of spring H, rupturing the vacuum within the tank.

When the piston of cylinder C1 (C2) begins to recoil, rack gear A moves rearward, causing the clockwise rotation of gear B, core E and cam F. Thus, cam F returns to the position shown in FIGS. 3*c* and 3*g*. Spring H causes door D to once again close. Valves 211, 221, 311 and 321, are then opened and a vacuum thus restored to tanks 21, 22, 31 and 32 (see FIG. 3*k*).

Suction holder 212 is provided at the bottom of upper vacuum tank 21, while suction holder 222 is provided at the top of lower vacuum tank 22. In addition, cylinder C3 is provided on one side of stock piler 2 to control the rotation (i.e., pivoting) of upper vacuum tank 21. On one side of the lower vacuum tank 22 there is a limit switch, LS2, and at the same side as cylinder C3, on about the level of lower vacuum tank 22, there is a limit switch LS2. On the same side as the cylinder C3, but placed on the opposite side of cylinder C3 relative to the upper and lower tanks, there is a limit switch LS4. On one side of stock piler 2, there is also provided a limit switch LS6.

Turning now to FIG. 5 and FIG. 6, it is seen that the stock piler 3 is similar to aforementioned stock piler 2 in the provision of an upper vacuum tank 31 and a lower vacuum tank 32, each incorporating a vacuum valve 311, 321, respectively, for connection to the vacuum pump. A number of suction holders 312, 322, and a packing (not shown) and vacuum rupturing system (not shown) are provided over the periphery of vacuum tanks 31, 32, and the vacuum rupture system operates under the control of cylinders C4 and C5 in a manner analogous to that shown in FIGS. 3*a*–3*h*. Suction holder 312 is provided at the bottom of the upper vacuum tank 31. Suction holder 322 is provided at the top of the lower vacuum tank 32. In addition, a cylinder C6 is provided at one side of the stock piler 3 to control the pivoting rotation of vacuum tank 31. To one side of the lower vacuum tank 32, there is provided a limit switch LS3; to one side of cylinder C6 there is provided a limit switch LS5; and also, to one side of the stock piler 3 for the feedstuff bag there is provided a limit switch LS7.

Referring to FIG. 7, FIG. 8, there is shown a top view and a front view, respectively, of the production station 4. It can be seen that said product station 4 includes a press table 41, a delivery means 42 and a pressing block 43, positioned above the press table 41, susceptible to longitudinal displacement under the command of cylinder C7, and a limit switch LS8 on one side.

FIG. 9 shows a layout perspective of the present embodiment. The configuration is shown in the order of activation means 1, stock piler 2 for the plastic bag, stock piler 3 for the feedstuff bag, and product station 4. Both upper vacuum tanks 21 and 31 are shown in the upwardly pivoted, open position. In addition, on one side of each of the stock pilers 2 and 3 there is a delivery means 23, 33, respectively. The delivery means conveys the finished feedstuff bags one by one to the lower vacuum tank 32, as required.

The operating procedure for the above described preferred embodiment according to the present invention is as follows:

First, switch SS1 is manually closed to activate the two delivery means 22, 23 to convey (typically on a conveyer belt) plastic bag 24 and feedstuff bag 34 to the upper side of lower vacuum tanks 22, 32, respectively, in the manner as shown in FIG. 10. Once the sides of each bag 24, 34 each come into abutment against limit LS2, LS3, (that is, to a position flush with both of the lower vacuum tanks 22, 32) vacuum valves 211 221, 311 and 321, are opened. Thus, vacuum tanks 21,22, 31 and 32 communicate with the vacuum pump.

In the meantime, cylinders C1, C2, C4, C5 are driven forward, as described above, causing door D to move to a closed position, thus sealing the vacuum tank. After door D has closed, the air within vacuum tanks 21, 22, 31 and 32 may be pumped out to create a vacuum within the tanks. Next, delay relay TR1, activated by LS2, LS3, causes cylinders C3, C6, after a predetermined period of time, to move the associated pistons with rack gears forward, causing a downward rotation of the two upper vacuum tanks 21, 31 to a horizontal level, in the manner illustrated in FIG. 10. Suction holders 212, 222, 312 and 322 then grab onto the plastic bag and the feedstuff bag, as mentioned earlier, from the upper side and the lower side respectively, by virtue of the suction that is produced by the vacuum in the vacuum tanks.

Figure 11:
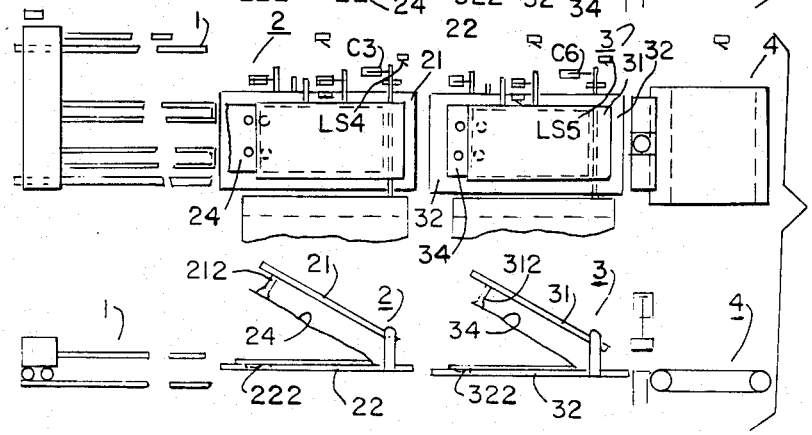
FIG. 11 is another perspective of the operation procedure of the preferred embodiment according to the present invention including both a top view and a front view thereof.

As the pistons of cylinders C3, C6 continue moving forward, they come into abutment against limit switches LS4, LS5, thus activating these limit switches. After a prescribed period of time set by the action of delay relay TR2, activated by limit switches LS4, LS5, the pistons and associated rack gears of cylinders C3, C6 are caused to move rearward, resulting in upward rotation of the two upper vacuum tanks 21, 31 to produce the open status as shown in FIG. 11, whereupon plastic bag 24 and feedstuff bag 34 will also be held in an open condition under vacuum absorption.

The same delay relay, TR2, starts the motor of activation means running, its power being transmitted to transmission shaft box 11, causing push wheel 12 to progress along rail 14. Of course, push bar 13 and abutment rod 15 follow in progression at the same time. Push bar 13 progressively projects into the open plastic bag 24. As push bar 13 approaches the terminal end of the plastic bag 24, abutment rod 15 comes into abutment against the limit or switch LS6 to result in closure of vacuum valves 211 and 221. The closure of vacuum valves 211 and 221 cuts off the vacuum line (not shown) from tank 21, 22 to the pump (not shown).

Figure 12:
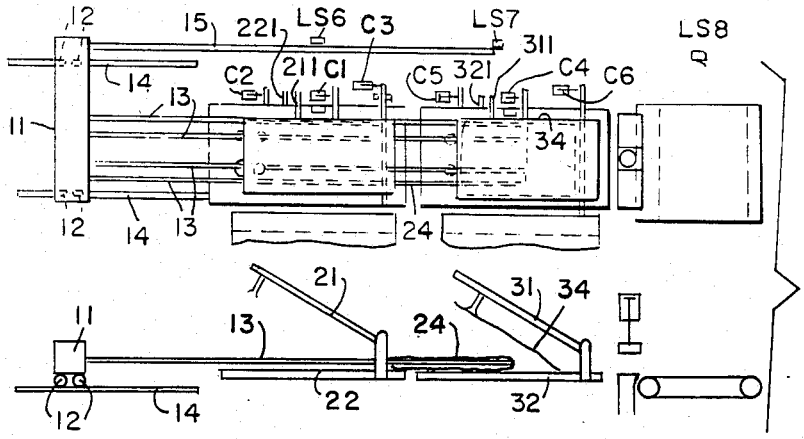
FIG. 12 is still another perspective of the operation procedure of a preferred embodiment of the present invention, including both a top view and a front view thereof.

In the meantime, the pistons and rack gears of cylinders C1, C2 will recoil, causing doors D on both the upper and lower vacuum tanks 21, 22 to open. Thus, the vacuum present in vacuum tanks 21, 22 is instantaneously ruptured, causing suction holders 222, 212 to lose their ability to hold onto the plastic bag by vacuum absorption. As a result, the open end of the plastic bag 24 will close up and be driven by push bar 13 to progressively become enclosed within the feedstuff bag 34, as illustrated in FIG. 12.

As push bar 13, together with plastic bag 24, are about to come into contact with the terminal end of feedstuff bag 34, abutment rod 15 abuts against limit switch LS7. Under the same mechanical principles and effects described above with regard to stock piler 21, vacuum valves 311, 321 are closed and the pistons and associated rack gears of cylinders C4, C5 rebound rearward, causing the doors D on both the upper and the lower vacuum tanks 31, 32 to open and the vacuum condition present in vacuum tanks 31, 32 to vanish. Thus, suction holders 322, 312 lose their vacuum absorption ability. As a result, the open end of feedstuff bag 34 falls down, with plastic bag 24 therein, for carriage by push bar 13 towards product station 4.

Feedstuff bag 34 with enclosed plastic lining bag 24 is then transferred to press table 41 and to delivery means 42 by push bar 13. Abutment rod 15 then comes into contact with limit switch LS8, thereby halting the motor and also causing cylinder C7 to move pressing block 43 downward.

Figure 13:
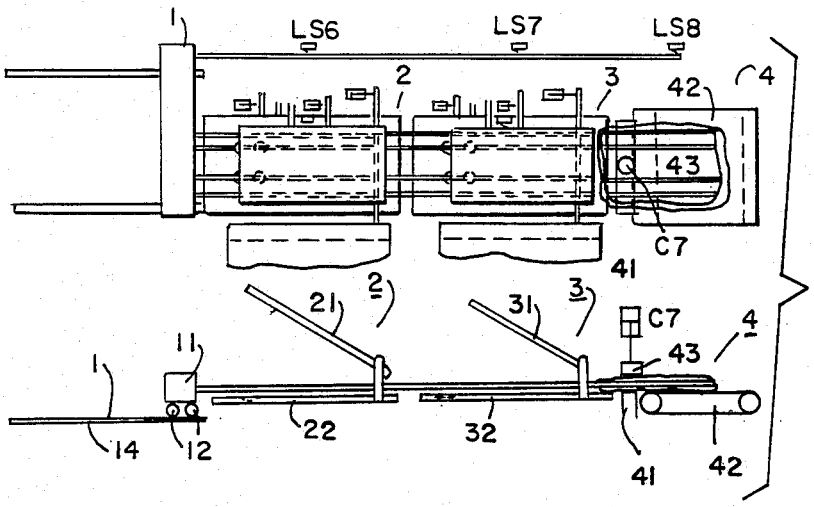
FIG. 13 is yet another perspective of the operation procedure of a preferred embodiment of the present invention including both a top view and a front view thereof.

Pressing block 43, upon reaching press table 41, presses the finished product against press table 41 as shown in FIG. 13. In the meantime, limit switch LS8, after a specified period of time determined by a delay relay TR3, causes the motor to run in the reverse direction, moving the whole activation mechanism 1 along rail 14. Concurrently, push bar 13 slids out of the finished product, which is held stationary on the press table by pressing block 41. After a specified time from when the motor starts running again, as determined by a delay relay TR4, activated by LS8, cylinder C7 lifts up press block 43. Delivery means 42 (also typically a conveyor belt) then conveys the finished product to another collection area, thereby completing one cycle of operation.

A succeeding cycle starts when abutment rod 15 completes its reverse motion and touches limit switch LS1, thereby activating delivery means 23, 33.

Figure 14:
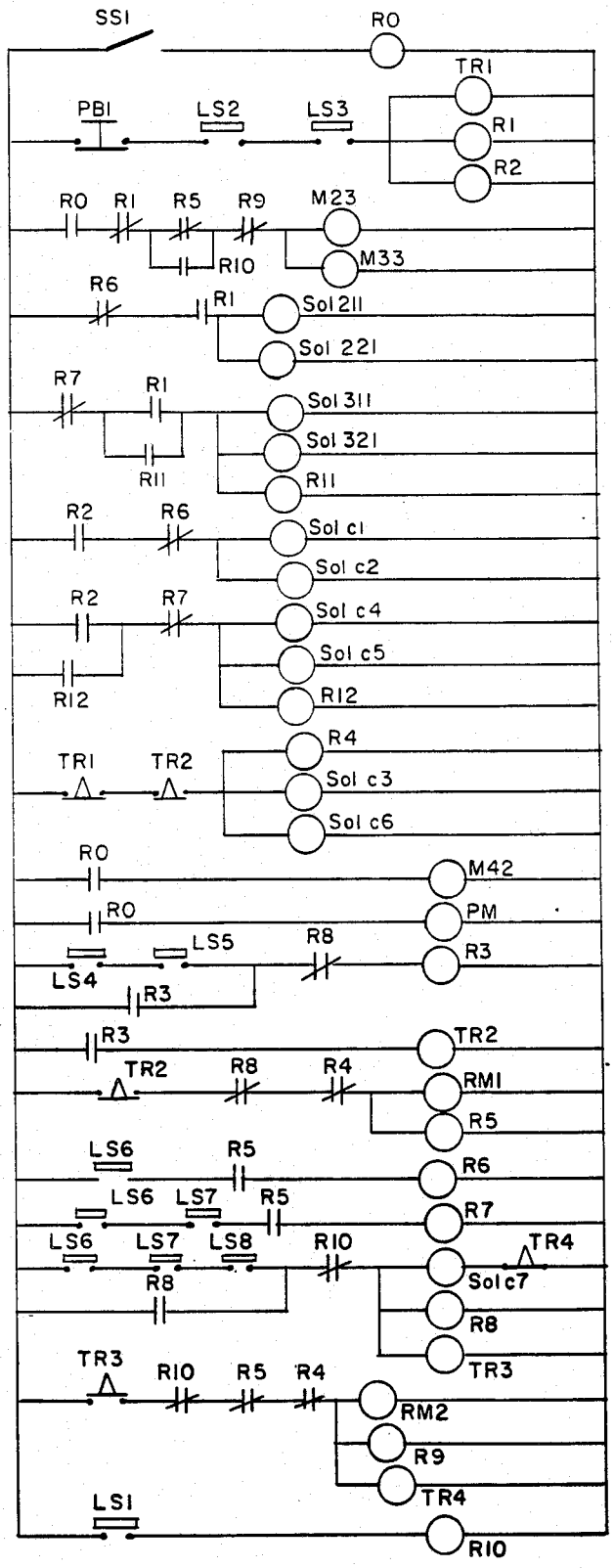
FIG. 14 is a schematic representation of a preferred embodiment of the circuit used to control the present invention.

FIG. 14 shows a typical circuit used to control the device of the present invention. The functioning of this circuit may be understood by reference to the above description, FIG. 14, itself, and the list of abbreviated symbols, used in FIG. 14, below:

| | |
|---|---|
| SS1 | rotary switch |
| PB1 | push-button switch |
| LS1 | limit switch 1 |
| LS2 | limit switch 2 |
| LS3 | limit switch 3 |
| LS4 | limit switch 4 |
| LS5 | limit switch 5 |
| LS6 | limit switch 6 |
| LS7 | limit switch 7 |
| LS8 | limit switch 8 |
| R0 | relay 0 |
| R1 | relay 1 |
| R2 | relay 2 |
| . | . |
| . | . |
| . | . |
| R12 | relay 12 |
| TR1 | delay relay 1 |
| TR2 | delay relay 2 |
| TR3 | delay relay 3 |
| TR4 | delay relay 4 |
| M23 | relay in control of the motor of conveyor belt 23 |
| M33 | relay in control of the motor of conveyor belt 33 |
| M42 | relay in control of the motor of conveyor belt 42 |
| Sol 211 | solenoid in control of the vacuum valve 211 |
| Sol 221 | solenoid in control of the vacuum valve 221 |
| Sol 311 | solenoid in control of the vacuum valve 321 |
| Sol C1 | solenoid in control of cylinder C1 |
| Sol C2 | solenoid in control of cylinder C2 |
| Sol C4 | solenoid in control of cylinder C4 |
| Sol C5 | solenoid in control of cylinder C5 |
| Sol C3 | solenoid in control of cylinder C3 to pivot the first upper tank |
| Sol C6 | solenoid in control of cylinder C6 to pivot the second upper tank |
| Sol C7 | solenoid in control of the pressing block C7 |
| PM | delay in control of the motor of vacuum pump |
| RM1 | delay in control of the forward motion of the motor of activation means |
| RM2 | delay in control of the reverse motion of the motor of activation means. |

From the above disclosure, it is apparent that a preferred embodiment according to the present invention will accomplish the automated introduction of a plastic bag's inner lining into a main feedstuff bag simply by feeding the plastic bag into the feedstuff bag one by one. All the cylinders, be they pneumatic or hydraulic, and the activation and travelling of the mechanisms involved, are controlled by such standard devices as limit switches, delay relays, and conventional control circuits. It is still a further advantage that the production cost of a machine according to the present invention is inexpensive. Also, it is noted that the applications of the present invention are not restricted only to operations involving introducing a plastic lining bag into a feedstuff bag. Anybody skilled in the art or enlightened by the description will find it easy to apply the present invention to operations involving the introduction any other kind of bag as a lining into another kind of main bag used as a packing means or otherwise.

It is believed that the foregoing disclosure should leave little doubt as to the practicality of the present invention. Although the invention has been shown and described with respect to a certain preferred embodiment, it is obvious that equivalent alterations, variants, and modifications will occur to others skilled in the art upon the reading and understanding of this specification. The present invention includes all such equivalent alterations and modifications.

What is claimed is:

1. A machine for putting a lining bag into a main bag by automation, comprising a rail of a fixed loci;

an activation means, including two push bars, which moves along said rail of fixed loci;

a first stock piling device for a lining bag, said lining bag having a sealed end and an unsealed end, including an upper and lower vacuum tank, said upper vacuum tank being pivotable between a closed and an open position with respect to said lower vacuum tank;

a second stock piling device for a main bag, said main bag having a sealed end and an unsealed end, including an upper and lower vacuum tank, said upper vacuum tank being pivotable between a closed and an open position with respect to said lower vacuum tank, first delivery means adjacent to said first stock piling device for delivering said lining bag to a surface of said lower vacuum tank of said first stock piling device facing said upper vacuum tank of said first stock piling device, second delivery means adjacent to said second stock piling device for delivering said main bag to a surface of said lower vacuum tank of said second stock piling device facing said upper vacuum tank of said second stock piling device, means for opening said lining bag comprising, on each of said upper and lower vacuum tanks, a suction holder on each of said surfaces facing said lower and upper vacuum tanks of said first stock piling device, respectively:

means for opening said main bag comprising, on each of said upper and lower vacuum tanks, respectively, a suction holder on each of said surfaces facing said lower and upper vacuum tanks of said second stock piling device, respectively;

means for creating a vacuum within said upper and lower vacuum tanks of said first and second stock piling devices associated with said tanks, causing said suction holders to develop suction power and hold said lining and main bag, respectively;

means, on each of said stock piling devices, for rupturing the vacuum within said upper and lower vacuum tanks, thereby causing said suction holder to lose suction power and release said lining and main bag, respectively;

said activation means and said first and second stock piling devices being arranged in relation to each other so that said lining bag, when released from said suction holder of said first stock piling device, may be pushed through said unsealed end of said lining bag by said push bars, into the unsealed end of said main bag when said main bag is in an open position on said second stock piling device, thereby forming a lined bag;

a press table adjacent said second stock piling device;

means above said press table for pressing said lined bag down against said press table.

2. The machine of claim 1, further comprising:

first switching means including means for actuating said means for creating a vacuum within said upper and lower vacuum tank of said first stock piling device, associated with said vacuum creating means, when said lining bag is flush with said lower vacuum tank of said first stock piling device and said upper and lower vacuum tanks of said first stock piling device are upwardly pivoted and means for actuating said means for rupturing said vacuum;

motive means including a delay relay connected to said first switching means for actuation by said first switching means to cause a downward pivoting rotation of said upper vacuum tank of said first stock piling device;

second switching means including means for actuating said means for creating a vacuum within said upper and lower vacuum tank of said second stock piling device, associated with said vacuum creating means, when said main bag is flush with said lower vacuum tank of said second stock piling device and said upper and lower vacuum tanks of said second stock piling device are closed and means for actuating said means for rupturing said vacuum; and motive means including a delay relay connected to said second switching means for actuation by said second switching means to cause a downward pivoting rotation of said upper vacuum tank of said second stock piling device.

* * * * *